US008961012B2

(12) United States Patent
Martin et al.

(10) Patent No.: US 8,961,012 B2
(45) Date of Patent: Feb. 24, 2015

(54) BAG WITH HANDLE

(71) Applicant: Peel Plastic Products Limited, Brampton (CA)

(72) Inventors: Michael Reid Martin, Toronto (CA); Brian George Hutchison, Brampton (CA); Arjang Tajbakhsh, Richmond Hill (CA)

(73) Assignee: Peel Plastic Products Limited, Brampton, Ontario (CA)

( * ) Notice: Subject to any disclaimer, the term of this patent is extended or adjusted under 35 U.S.C. 154(b) by 0 days.

(21) Appl. No.: 13/655,784

(22) Filed: Oct. 19, 2012

(65) Prior Publication Data

US 2014/0112599 A1 Apr. 24, 2014

(51) Int. Cl.

| | |
|---|---|
| ***B65D 33/10*** | (2006.01) |
| ***B65D 33/06*** | (2006.01) |
| ***B65D 30/08*** | (2006.01) |

(52) U.S. Cl.
USPC ..... 383/10; 383/17; 383/109; 383/22

(58) Field of Classification Search
USPC ..... 383/8, 10, 21, 25–29, 17, 109, 113
See application file for complete search history.

(56) References Cited

U.S. PATENT DOCUMENTS

| | | | | |
|---|---|---|---|---|
| 4,252,269 A | | 2/1981 | Peppiatt | |
| 4,539,705 A | | 9/1985 | Baines | |
| 4,576,316 A | * | 3/1986 | Foster | 222/541.6 |
| 4,854,733 A | * | 8/1989 | Schwinn | 383/29 |
| 4,857,037 A | * | 8/1989 | Schwinn | 493/195 |
| 4,867,575 A | | 9/1989 | Wood | |
| 5,121,995 A | * | 6/1992 | Newman et al. | 383/29 |
| 5,186,542 A | * | 2/1993 | Seabold | 383/25 |
| 7,494,279 B2 | | 2/2009 | Marquet et al. | |
| 8,430,566 B2 | * | 4/2013 | Brauer et al. | 383/66 |
| 2009/0202181 A1 | * | 8/2009 | Alaux | 383/7 |
| 2011/0033133 A1 | | 2/2011 | Kujat | |
| 2011/0229060 A1 | | 9/2011 | Koesters | |

FOREIGN PATENT DOCUMENTS

| | | | | |
|---|---|---|---|---|
| DE | 3644618 A1 | * | 7/1988 | B65D 33/08 |
| DE | 3644620 A1 | * | 7/1988 | B65D 33/08 |
| DE | 3803148 A1 | * | 8/1989 | B31B 37/00 |
| EP | 439209 A1 | * | 7/1991 | B65D 33/10 |
| EP | 450114 A1 | * | 10/1991 | B31B 19/26 |
| EP | 2039620 A1 | * | 3/2009 | B65D 33/10 |

OTHER PUBLICATIONS

Machine translation of EPO Document No. 0 450 114. Translated on Dec. 13, 2013.*
Machine translation of German Document No. 36 44 620. Translated on Dec. 13, 2013.*

* cited by examiner

*Primary Examiner* — Jes F Pascua
(74) *Attorney, Agent, or Firm* — Stuart L. Wilkinson

(57) ABSTRACT

A bag has a front panel, a back panel, and a gusset panel. Either or both of the front panel and the gusset panel at one side has an extension, and either or both of the back panel and the gusset panel at the other side has an extension. The extensions are welded together at outer margins thereof so that the width of the combined extensions is greater than the width of the gusset panel. The extensions are formed with carrying apertures.

28 Claims, 10 Drawing Sheets

BAG WITH HANDLE

FIELD OF THE INVENTION

This invention relates to a bag having a carrying handle.

DESCRIPTION OF RELATED ART

Plastic bags are a ubiquitous and highly practical mode of carrying things and there is a whole panoply of shapes and structures of such bags depending on the particular function of the bag. Many bags have handles of some kind or other. These may be merely formations in the material of the bag itself or may include additional elements which are attached to the main carcass of the bag and which provide added strength and convenience.

Of particular interest from the viewpoint of reducing packaging materials are plastic bags that might replace in the marketplace freestanding, relatively thick-walled plastic jugs. Such a replacement is desirable for many reasons. Firstly, the volume of plastic material required in thick-walled plastic jugs is generally much higher in comparison with plastic bags configured to function as jugs. Secondly, placing of graphic materials is much easier on plastic bags where simple printing directly onto a paper-like plastic sheet can be implemented with the plastic sheet or a ply thereof being of a material such as polyester which readily accepts industry standard printing inks. This is in comparison with stiff-walled jugs which generally have some contour in the walls making it difficult for a print head to seat against anything but a very small wall area. This essentially mandates a relatively expensive process step of attaching labels to such jugs. Finally, prior to filling, thick-walled jugs being stored or shipped take considerable space in comparison with a compact stack of flat plastic bags.

The structure of a handled bag that is to function as a jug should have the strength to hold granular or fluid contents. It should also have a form enabling it to be gripped in one hand, moved from a standing into a pouring position and back again, and, ideally, for the pouring position to be retained as substantially all the contents of the bag are poured from a spout or functionally similar means. Throughout the use cycle, the bag should substantially retain a jug form and function until the contents have been emptied. Finally, such a structure must be easy to manufacture.

While bags with handles are known that can provide a substitute for jugs made of more rigid materials, further improvements are possible to improve the performance and manufacturability of such bags. Limitations and disadvantages of conventional and traditional approaches to bag-with-handle designs and manufacture thereof will become apparent to one of ordinary skill in the art through comparison of such bag and handle arrangements with the present invention.

SUMMARY OF THE INVENTION

According to one aspect of the invention, there is provided a bag having a front panel, a back panel, and a gusset panel, all formed of multi-ply plastic sheet material, each panel having a thermoplastic ply at its interior face and a non-thermoplastic ply at its exterior face, the gusset panel having a first interior margin portion along one side thermally welded to a second interior margin portion of the front panel at a first join, and a third interior margin portion along an opposed side thermally welded to a fourth interior margin portion of the back panel at a second join, a first extension integral with the front panel and extending from the first join, and a second extension integral with the back panel and extending from the second join, the first extension having a first seam portion spaced from the first join, the second extension having a second seam portion spaced from the second join, the first and second seam portions having thermoplastic ply portions facing one another and thermally welded together at a third join, the first and second extensions each having a carrying aperture formed therein, the gusset panel having a third extension integral with the gusset panel and extending from the first join, and having a fourth extension integral with the gusset panel and extending from the second join, the third extension thermally welded to the first extension, the fourth extension thermally welded to the second extension, the third and fourth extensions each having a carrying aperture formed therein, the carrying apertures in the extensions aligned with one another, the first and second extensions overlapping the third and fourth extensions respectively at first and second overlaps, a part of one of the first and second extensions projecting beyond the respective overlap being a respective one of the first and second seam portions.

Dimensionally, the cumulative spacing of the first join from the third join plus the spacing of the second join from the third join is preferably greater than the spacing of the first join from the second join across the gusset panel.

Preferably the front and back panels and the first and second extensions are formed from a first, folded web of multi-ply plastic sheet material, and the gusset panel and the third and fourth extensions are formed from a multi-ply plastic sheet material insert, either as a totally separate insert or as a part cut from the first folded web of multi-ply plastic sheet material.

In one form of the bag, said second interior margin portion of the front panel forms a part of the perimeter of the front panel, said third interior margin portion of the back panel forms a part of the perimeter of the back panel, and the remaining part of the front panel perimeter is sealed to the remaining part of the back panel perimeter. Preferably, the seal between said remaining part of the front panel and the remaining part of the back panel includes a bridging element. The bridging element can be an openable and closable spout, the spout and a handle defined by the carrying apertures being on generally opposed sides of the bag. Alternatively or in addition, the bridging element can be a second gusset panel. Preferably, the seal between said remaining part of the front panel and said remaining part of the back panel includes a weld over at least part thereof between overlapping margin portions of the front panel and the back panel.

Preferably, at least a part of the bag is made of a multi-ply material including a thermoplastic material ply. The multi-ply material can include a ply of a material amenable to accepting printing thereon. The multi-ply material can include a barrier layer generally preventing the transmission of gases. Preferably, the joins extend generally along the length of the bag, the extensions being of a length less than the first and second joins. The third join can include a strengthening member for easier handling of the bag as a jug. The third join is preferably of a length less than the first and second joins. The carrying apertures are preferably of slot form.

The gusset panel and the extensions can together forming a generally hollow tube, the tube flattened when the bag is empty and expanding to a generally triangular cross-section for accommodating a hand part for carrying of the bag when the bag is full.

According to a further aspect of the invention, there is provided a bag having a front panel, a back panel, and a gusset panel, all formed of multi-ply plastic sheet material, each panel having a thermoplastic ply at its interior face and a non-thermoplastic ply at its exterior face, the gusset panel having a first interior margin portion along one side thermally welded to a second interior margin portion of the front panel at a first join, and a third interior margin portion along an opposed side thermally welded to a fourth interior margin portion of the back panel at a second join, a first extension integral with the front panel and extending from the first join, and a second extension integral with the back panel and extending from the second join, the first extension having a first seam portion spaced from the first join, the second extension having a second seam portion spaced from the second join, the first and second seam portions having thermoplastic ply portions facing one another and thermally welded together at a third join, the first and second extensions each having a carrying aperture formed therein, the gusset panel having a third extension integral with the gusset panel and extending from the first join, and having a fourth extension integral with the gusset panel and extending from the second join, the third extension thermally welded to the first extension, the fourth extension thermally welded to the second extension, the third and fourth extensions each having a carrying aperture formed therein, the carrying apertures in the extensions aligned with one another, the first and second extensions overlapping the third and fourth extensions respectively at first and second overlaps, a part of one of the first and second extensions exposed through an aperture in the respective overlapping third or fourth extension being a respective one of the first and second seam portions.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
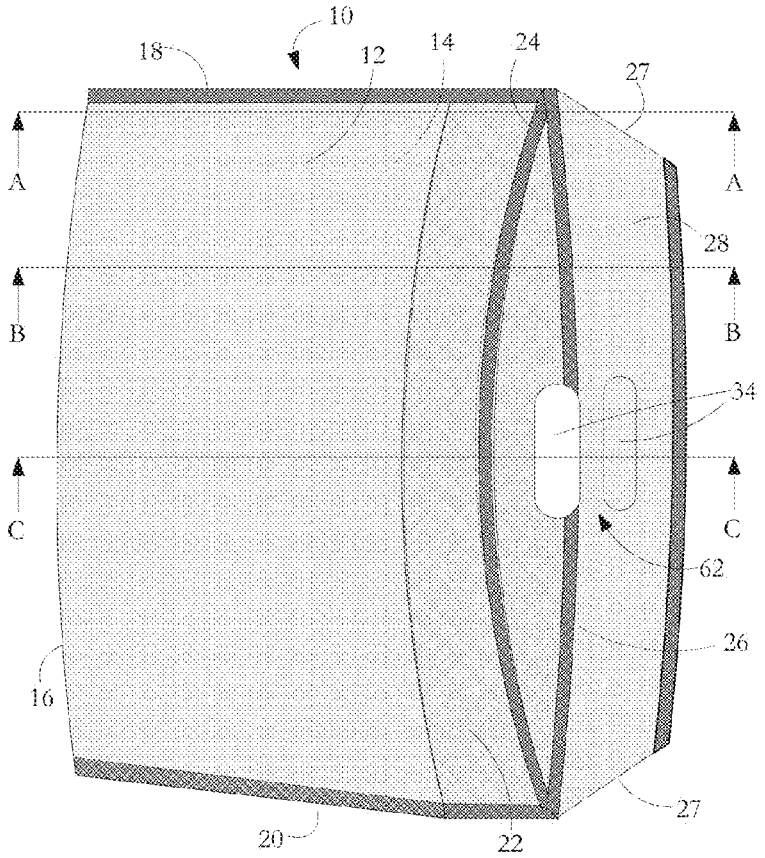
FIG. 1 is a side view of a bag according to an embodiment of the invention.
Figure 2:
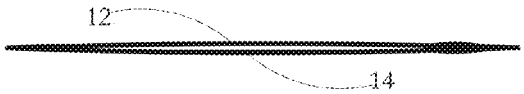
FIGS. 2 to 4 show sectional views on the lines A-A, B-B, and C-C respectively of FIG. 1 when the bag contains granular or fluid material.
Figure 3:
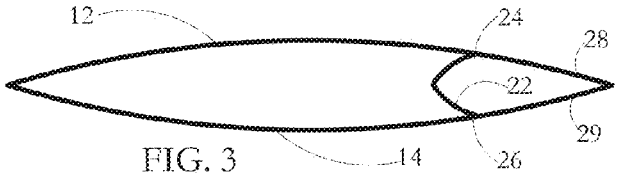
Figure 4:
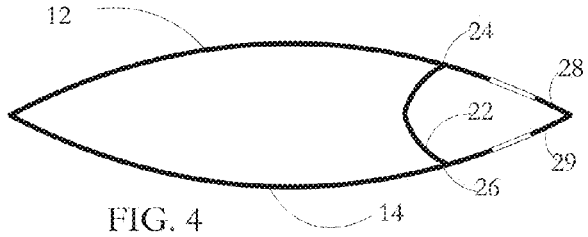
Figure 5:
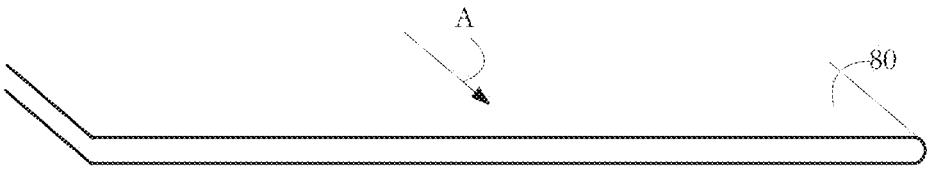
FIGS. 5 to 9 show successive views of parts of the bag of FIG. 1 in the course of its manufacture in a handle side mount process according to an embodiment of the invention.

Referring to FIG. 1, there is shown a pouch form bag 10 formed of plastic sheet material having a front panel 12 and a back panel 14. The front and back panels 12, 14 are joined at one side 16 either as a seam weld, by folding of the original web sheet material from which the bag is formed, or by a gusset panel. At the top and bottom of the bag, the front and back panels 12, 14 are joined by seam welds 18, 20, but could alternatively incorporate gusset panels either as separate panels welded to flanking panels 12, 14 or formed as a fold in the sheet plastic material. A side gusset panel 22 extends between panels 12, 14 and is seam welded to them at welds 24, 26. Extending from the seam welds 24, 26 on the distal side of the welds from the panels 12, 14 are panel extension pieces 28, 29. The extension pieces 28, 29 each have a slot form aperture 34 formed generally centrally within the extension pieces, the apertures 34 being aligned with each other, the extension pieces together forming a handle 62. The extension pieces 28, 29 are cut away as shown at 27 to allow the gusset panel 22 to operate effectively when the bag is filled. The structure of FIG. 1 is shown in cross-section in FIGS. 2-4.

Further details of the structure of the FIG. 1 bag are illustrated by FIGS. 5-10*a* which illustrate stages in an exemplary production process for the bag. The production process is particularly adapted to the use of a sheet material having two face plies, one made of a material having high thermoplasticity and the other made of a material which is relatively unthermoplastic. Such a sheet material could, for example, be a multi-ply sheet plastic material having a thermoplastic polyethylene ply at one surface and a polyester ply at the reverse surface, the latter being particularly suited for accepting printed indicia but not being thermoplastic.

Figure 6:
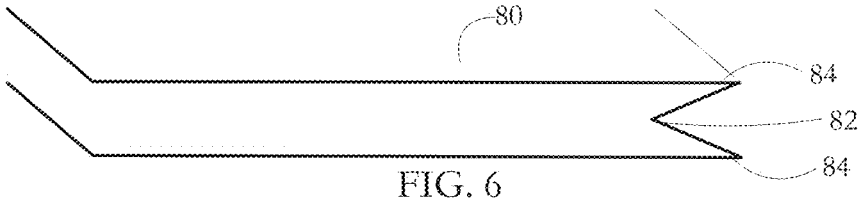
Figure 7:
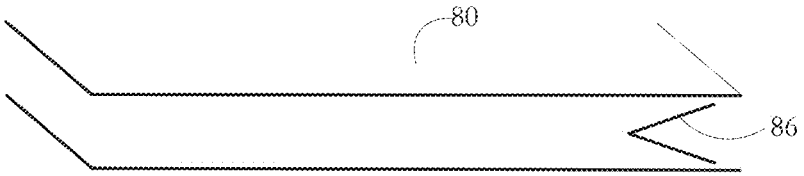

To obtain a high production rate, processing operations are performed on a continuous web of plastic sheet material. During a production run, the web is fed continuously under tension from an input end where the web is unformed to an output end where, essentially, a complete bag has been produced and is cut from the web leading end. The web is led past a series of processing stations where processing operations are performed including, for example, positioning, stamping, cutting, folding and thermoplastic welding, depending on the stage of manufacture of the bag. As shown in FIGS. 5 to 9 which depict a handle side mount production process, a leading end portion of such a web 80 is shown moving in the direction of arrow A. The web is folded (FIG. 5) and a tuck 82 is formed at the location of the fold (FIG. 6). At a subsequent station, the web is slit (FIG. 7) at apices 84 of the two folds formed by the tuck 82. This creates a separated V-section gusset panel 86 which is then combined with a handle web 88 at a combining station.

Figure 8:
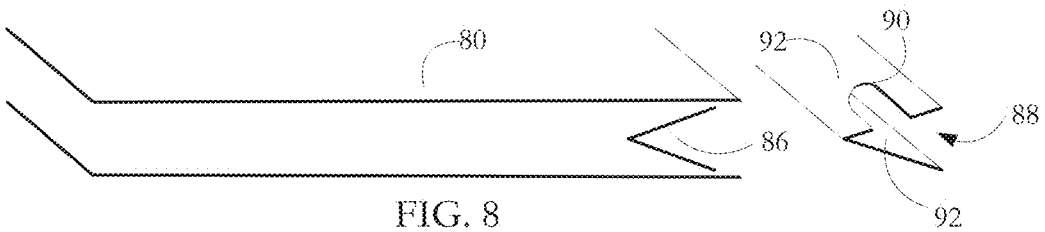
Figure 9:
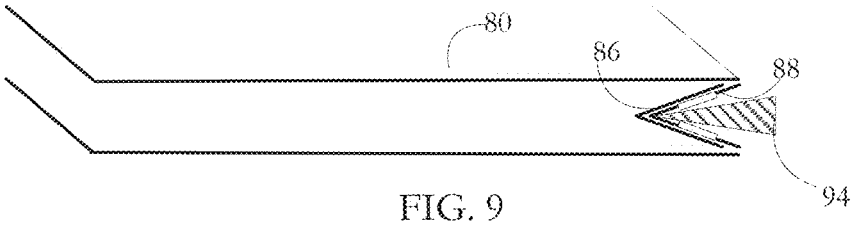

Before reaching the combining station, the handle web 88 is similarly processed as a continuous web drawn under tension (FIG. 8). The handle web 88 in this embodiment is made of polyethylene sheet material but, if desired, a multiple ply plastic sheet material can be used. For example, a nylon ply can be incorporated for strength, while a polyester ply can be used if the handle is to receive printed indicia. The handle web 88 is subjected to a stamping step to create carrying apertures 90 and to a folding step to produce wing sections 92 with an aperture 90 located at the centre of each wing section 92. The two webs 80, 88 are brought together at the combining station and, using a positioning blade 94, the folded gusset and handle panels 86, 88 driven to the left as shown so that they lodge a precise distance into the gap between panels of the folded bag web 80 (FIG. 9).

Figure 10A:
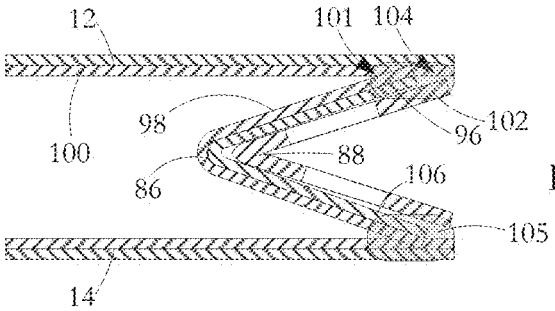
FIGS. 10*a* and 10*b* show sectional views to a larger scale of part of the bag of FIG. 1 during its manufacture.
Figure 10B:
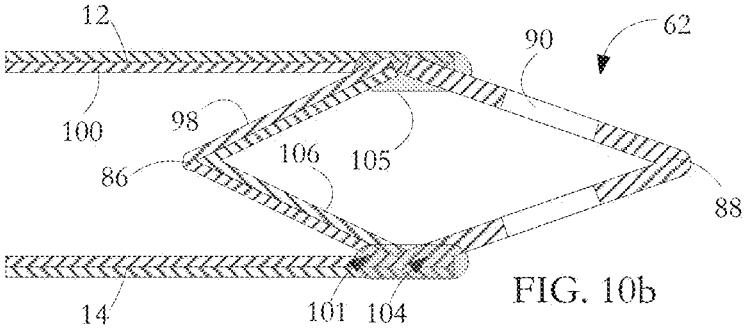

As shown in FIG. 10*a*, the method of cutting and positioning results in a desired juxtaposition of polyethylene plies to enable thermoplastic welding/sealing. Thus, regions 96 of the gusset panel 86 have a polyethylene ply 98 facing a polyethylene ply 100 of the bag panels 12, 14 at contact regions 101. Regions 102 of the polyethylene handle part 88 also face the polyethylene ply 100 of the bag web panels 12, 14, but at regions 104 immediately adjacent the regions 101. The overlapping parts of the webs, including the handle part, are then passed through a series of heat welding stations where a weld 105 is effected to cover both the regions 101 and 104. The hot press tool (not shown) applies heat and pressure through polyester plies to hot melt the underlying polyethylene of the panel edges and the edges of gusset part 86 and handle part 88. The polyester plies are not melted but they do transmit the applied heat to the polyethylene. FIG. 10*a* depicts a finished bag with the handle 62 nestled against gusset panel 22 whereas FIG. 10*b* shows the handle 62 pulled out to a position it would have for carrying or pouring purposes.

Figure 11:
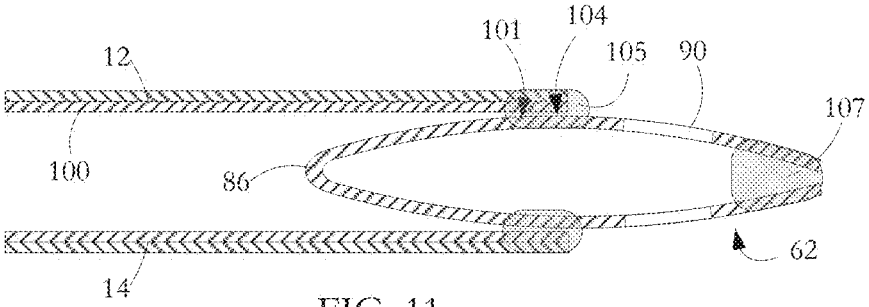
FIG. 11 shows a sectional view at the same larger scale illustrating an alternative handle construction being formed during manufacture of a bag.
Figure 12:
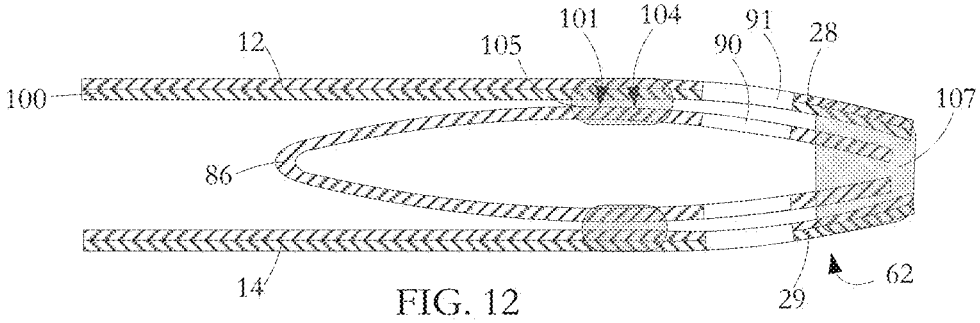
FIG. 12 shows a sectional view at the same larger scale illustrating a further alternative handle construction being formed during manufacture of a bag.

Referring in detail to FIGS. 11 and 12, there are shown alternative handle arrangements. As in the embodiments of FIGS. 10*a* and 10*b*, these have the merit of a desired juxtaposition of polyethylene plies to enable thermoplastic welding/sealing. A particular advantage of these embodiments is that in the course of production, and in comparison with the process described with reference to FIGS. 5 to 9, no separate insert is required. Instead, a folded strip is cut from the web, in a process step similar to that illustrated in FIG. 7. The folded strip therefore has the same multi-ply structure as the primary web and so has one face which can be heat welded and the other face which is not thermoplastic. The folded strip is the source of both the bag handle and the associated gusset panel.

In the case of the FIG. 11 structure, such a folded strip 168 is partly inserted into a gap between the front and back panels 12, 14 so that parts of the folded strip project out beyond the front and back panels 12, 14. The projecting parts have apertures 90 by means of which the completed bag can be carried. The inserted part of the folded strip makes up the gusset panel 86 and the outwardly projecting parts are joined together and function as the carrying handle 62. End regions of the gusset panel 86 contact respective edge portions of the polyethylene ply 100 of the bag web panels at respective junction contact regions 101. The polyethylene plies of the gusset panel and the respective front and back panels are welded at those junctions as shown at 105. Edge regions of the outwardly projecting parts of the folded strip contact each other at a further junction region and the contacting polyethylene plies are glued together as shown at 107. Whereas welds and glued areas are shown as thick structures, it will be understood that this is for illustrative purposes only. In fact, welded areas are normally of sheet plastic form almost indistinguishable from the sheet plastic making up the bag panels. For strength and handling comfort the welds 105 and 107 extend almost to the apertures 90 but the boundaries of the welds are separated from the boundaries of the respective apertures by a distance of about one quarter of an inch.

In the case of the FIG. 12 structure, the folded strip is fully inserted into a gap between extensions 28, 29, respectively, of the front and back panels 12, 14. An inner part of the folded strip makes up the gusset panel 86 with end regions of the gusset panel 86 contacting and heat welded at welds 105 to respective inner surface portions of the polyethylene ply 100 of the bag web panels at respective junction contact regions 101. Outer parts of the folded strip have apertures 90 aligned with apertures 91 in the front and back panels 12, 14, the aligned apertures in the completed bag serving to enable carrying of the bag. Outer edge regions of the folded strip and outer edge regions of the extensions 28, 29 of the front and back panels 12, 14 contact each other at a further junction region where all four layers are welded at weld 107.

The web may be subjected to other welding steps to seal panels at their edges. However, one seam is left open to allow customers to fill the bag, this seam being welded by the customer after the bag is filled. In the case of the embodiment of FIGS. 5, 6 and 7, the seam that is left open for shipping is conveniently the gap formed when the two "pages" of the web 80 are folded, as shown at the left hand side of the figures.

Figure 16:
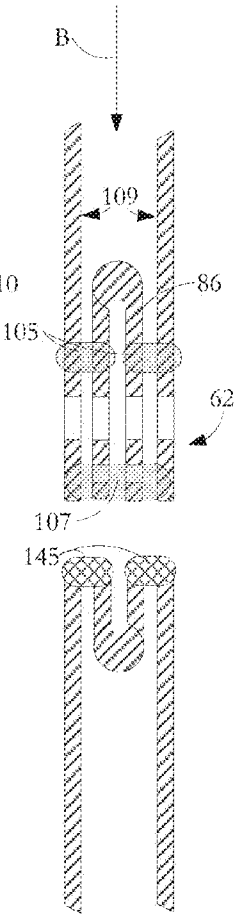
FIGS. 14 to 16 show parts of a bag in the course of successive stages in its manufacture in a handle cross mount process according to an embodiment of the invention.
Figure 14:
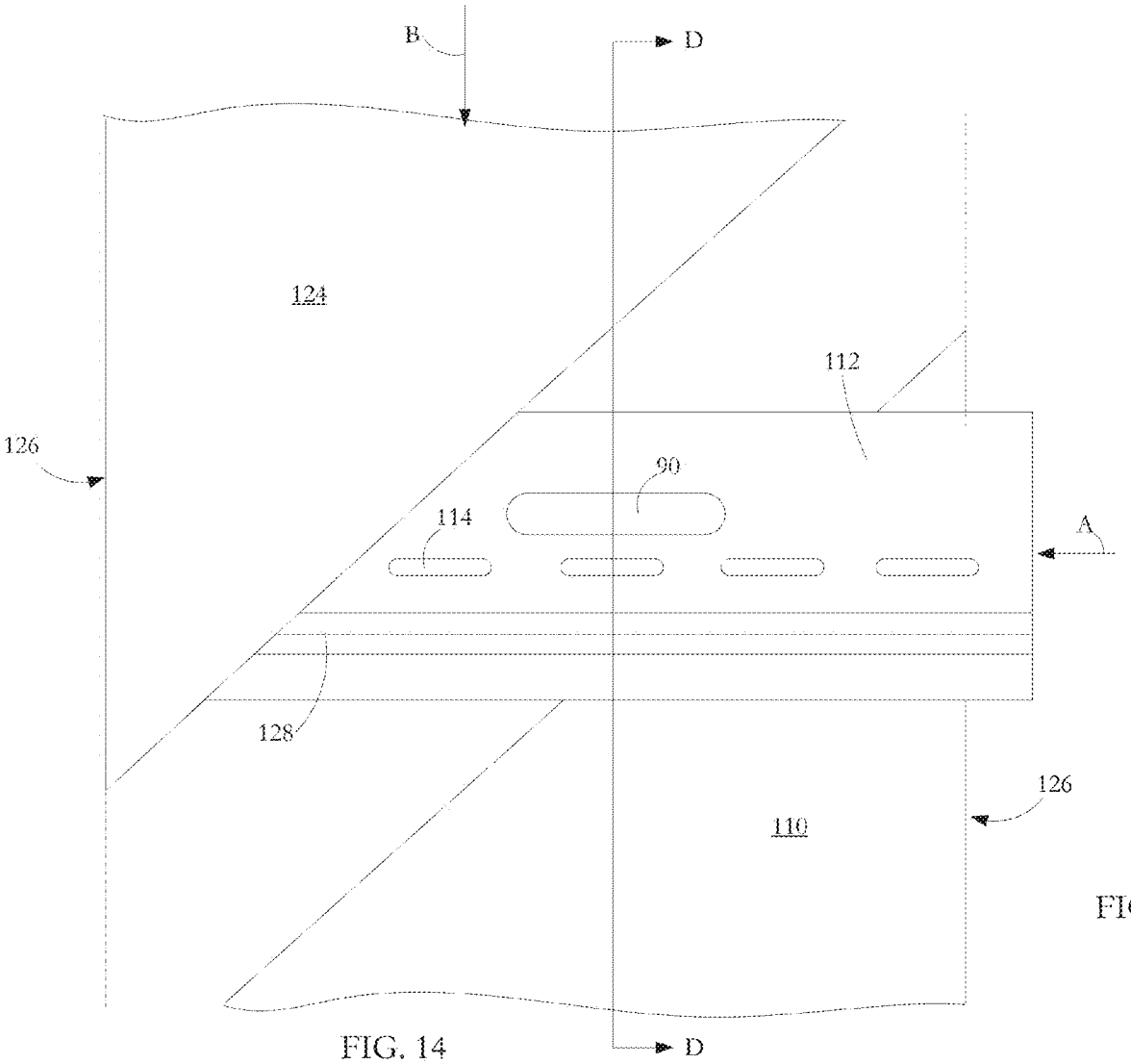

It will be understood that a handled bag using the principles of the invention can be made in many different ways. For example, as shown in the sequence of manufacturing steps illustrated in FIGS. 14-16, a strip comprising a combined handle web portion and gusset panel are applied from the side (arrow A) as bag webs 110, 124 are driven in the direction of arrow B. The bag webs 110, 124 consist of successive sections that are, respectively, to be bag front and back panels, the webs 110, 124 having a polythene ply at the surface 109 and a polyester ply at the reverse surface. At a tacking station, a double gusset web portion 112 folded at each end as shown is moved across the bag web 110 and tack welded to it. The double gusset web portion 112 has aligned handle apertures 90 and aligned welding apertures 144 with a polyethylene ply at surface 118 and a polyester ply at its reverse surface.

Figure 15:
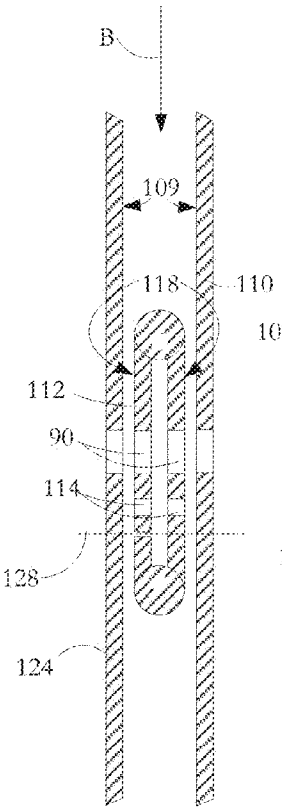

Following tack welding of the double gusset web portion 112 to the web 110, the web 124 is brought down onto the web 110 with the web portion 112 sandwiched between the webs 110 and 124. The assembly is then advanced to a seam welder where a hot press tool produces thermoplastic welds at polyethylene contact regions. As in the prior embodiment, the juxtaposition of the webs 110, 112 and 124 is such as to bring polyethylene plies face-to-face in order to be able to effect thermal welds at desired regions. Thus, as illustrated in FIG. 15 (showing the arrangement of facing polyethylene plies) and FIG. 16 (showing the position of thermal welds) the polyethylene plies 118 face the polyethylene plies of webs 110, 124. Sealing thermal welds are made at 105 to attach the webs 110, 124 to the web portion 112 at positions corresponding in the finished bag to the end regions of the gusset panel 86. The weld positions 105 also correspond to inner end regions of contiguous parts of the handle 62. Outer end regions of the handle parts are joined at a thermal weld 107 which fasten four plies together. This includes a weld between the inner polythene plies of the webs 110, 124 which are effected through the through holes 114. Further welds are effected at 145, corresponding to a gusset panel of the preceding bag in the continuous process and along edges 126. The preceding, finished bag is then separated by cutting at line 128, the detached bag having side gusset panels with one side gusset panel having an associated handle 62.

The choice of attaching the gusset/handle in a side mount process or a cross mount process generally depends on the location of other gusset panels. It will be appreciated that, viewing the handle seams as being along one side of the bag, additional gusset panels can be incorporated along one or both of the top and bottom of the bag and along the opposite side of the bag, provided that a region of the bag perimeter is left open for filling.

Figure 17:
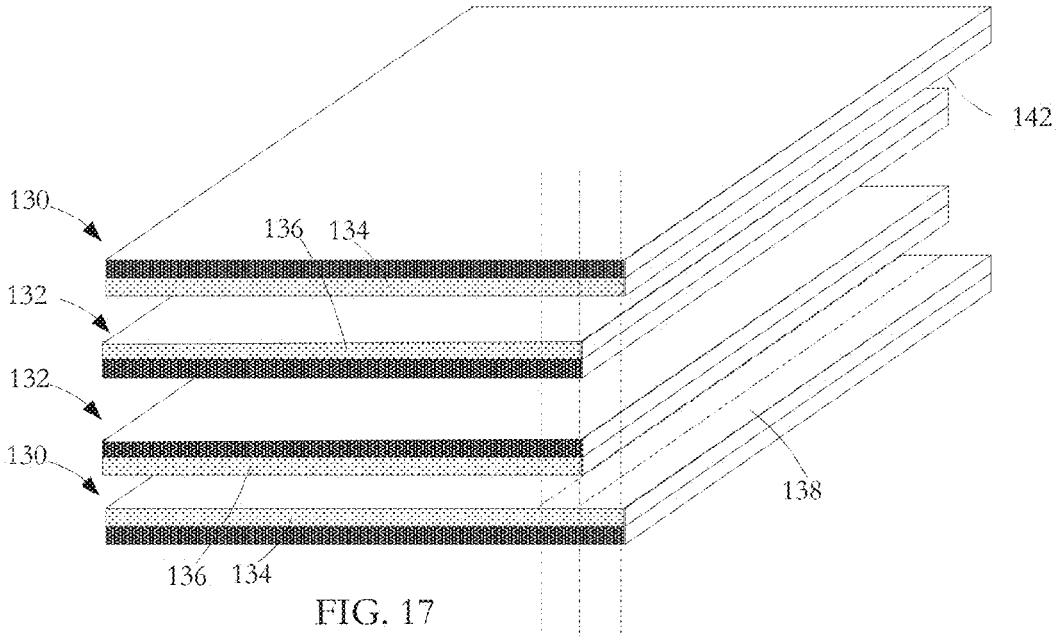
FIGS. 17 and 18 illustrate techniques for welding sheet plastic material according to embodiments of the invention.

As illustrated in FIGS. 10*a* and 10*b*, the contiguous welds at regions 101, 104 can provide a strong, sealing union between pieces of a plastic sheet material which have a heat weldable ply at one surface and a non-heat weldable ply at the opposite surface. As shown in the exploded view of FIG. 17, the union is characterized by plastic sheets 130, 132 having heat weldable plies 134, 136 facing one another but with the sheets 130 projecting beyond respective sheets 132 to form projecting margins 138. In this arrangement, a single weld with contiguous regions serves to weld each sheet 130 to its adjacent sheet 132, but also serves to weld the two sheets 130 together. The multiple union thermal weld may find application in structures additional to the bag handle arrangement shown in the previous figures, particularly where the need to print indicia or the need for other characteristics of the sheet plastic material mean that a ply at one surface does not lend itself readily to thermoplastic welding whereas a ply at the opposite surface is heat weldable.

Figure 18:
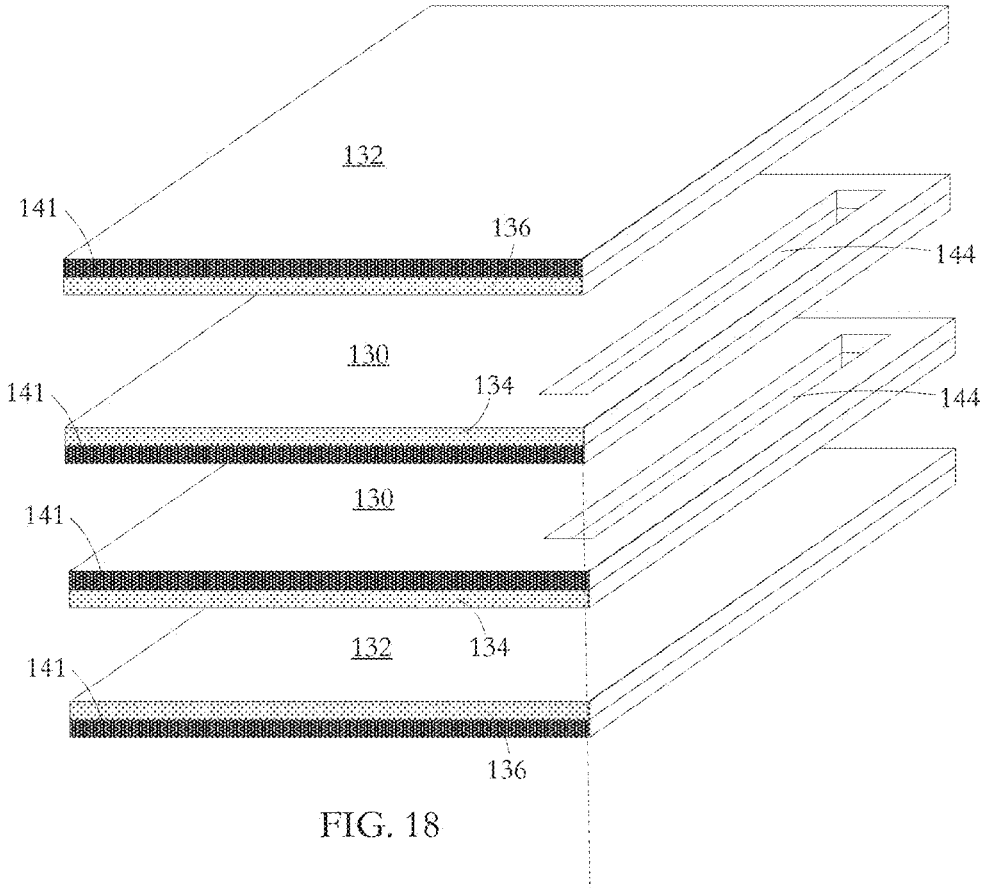

An alternative implementation is illustrated in FIG. 18. Here, plastic sheets 130 and 132 have polyethylene plies 134, 136 facing one another and plies 141 at their other surfaces that are not thermally weldable. The sheets 130 have apertures 144 by means of which a polyethylene ply 136 of one of the sheets 132 is exposed to the polyethylene ply 136 of the other sheet 132 when the sheets 130 and 132 are brought together. The sheets 130, 132 are then heat welded together so that the contact regions between respective facing sheets 130, 132 are welded at a region surrounding the aperture 144, and other contact regions of the sheets 132 are thermally welded through the apertures 144. It will be appreciated that in this embodiment, the multiple union is effective in terms of strength but, unlike the FIG. 17 embodiment, may not be effective as a seal because part of the polyethylene ply of the sheets 132 overlay non-thermoplastic plies of the sheets 130.

Figure 19:
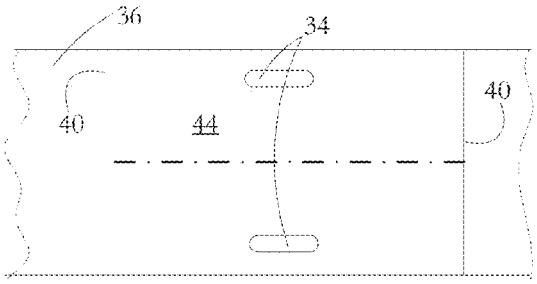
FIGS. 19 to 24 show views of parts of a bag similar to the bag of FIG. 1 in the course of its manufacture in an alternative manufacturing process according to an embodiment of the invention.
Figure 20:
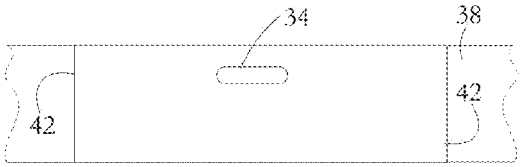
Figure 21:
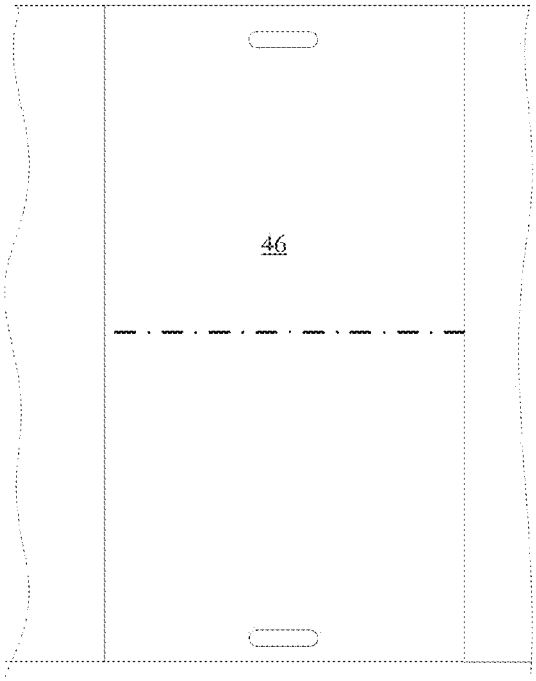
Figure 22:
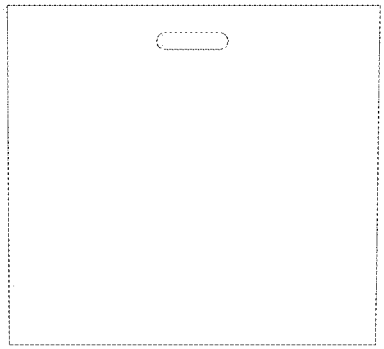
Figure 23:
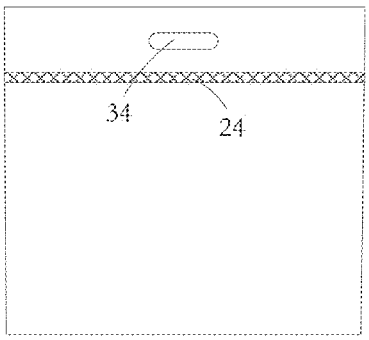
Figure 24:
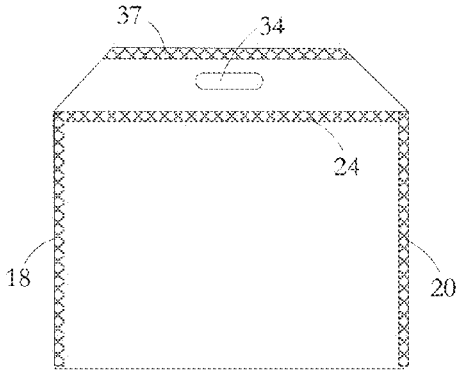
Figure 25A:
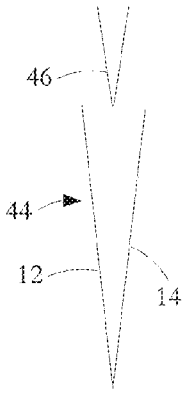
FIGS. 25*a* to 25*e* are sectional views showing stages in the exemplary manufacturing method described with reference to FIGS. 19 to 24.
Figure 25B:
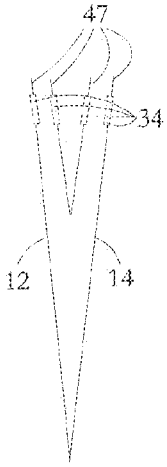
Figure 25C:
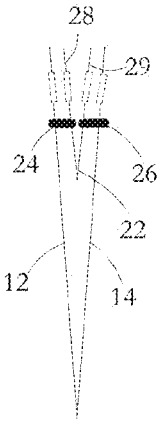
Figure 25D:
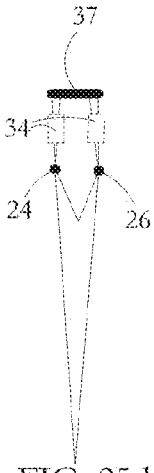
Figure 25E:
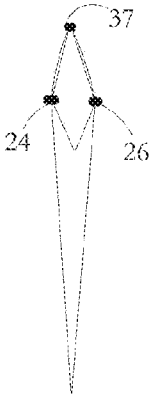
Figure 25F:
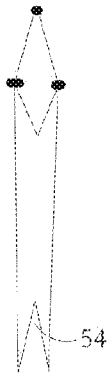
FIG. 25*f* is a sectional view showing an alternative to the bag configuration of FIG. 25*e* according to an embodiment of the invention.

Alternative embodiments of bag structure and method of manufacture are shown with reference to FIGS. 19 to 25. These figures illustrate a bag structure characterized by a sheet material, such as polyethylene, which is heat weldable at both of its faces. The figures also illustrate a method of manufacturing the bag from separate web portions. Such a method may be adopted for example in a short production run where it is inefficient to set up continuous process equipment. FIGS. 19 to 24 show web portions, and a bag structure formed from the web portions, in plan view, while FIGS. 25*a* to 25*e* show the web portions and bag structure in vertical sectional view with lengths of the plastic sheet material depicted as lines. Referring firstly to FIGS. 19 and 20, two webs of plastic sheet material are processed: a wide web 36 and a narrow web 38. Apertures 34 are first formed in the webs 36, 38 in punching procedures. The webs 36, 38 are then cut at lines 40, 42 respectively to form rectangular web portions 44, 46 and the web portions are folded as shown in FIGS. 20, 22 and 25*a*. Then, as shown in sectional view in FIG. 25*b*, the smaller V section piece is inserted into the larger V-section piece so that edges 47 are aligned with each other and the apertures 34 are aligned with each other. As shown in FIG. 25*c*, the smaller V-section piece is then welded to the respective front and back panels 12, 14 as shown at 24, 26. This leaves a region between the welds 24, 26 to function as the gusset panel 22, so allowing the front and back panels 12, 14 to be pulled apart when the bag is filled up to a limit determined by the width of the gusset panel 22. As shown in FIG. 25*d*, the overlapping extension lengths 28, 29 are seam welded to each other and to the panels 12, 14 as indicated at 37. The welds 24, 26 are each spaced from the weld 37 by sections of sheet plastic material within which the apertures 34 are present. Further seam welds 18, 20 are applied along the top and bottom of the bag. It will be appreciated however that this may be a two-phase operation with one of the welds 18, 20 being left open to permit filling of the bag 10 which is then sealed by applying the final seam weld. It will also be appreciated that other folds can be configured, such as that shown in FIG. 25*f* to provide further gusset panels 54, the folds being implemented before the side seams 18, 20 are welded. Such additional gussets provide for further storage volume in the bag and, as will be explained presently, are of particular value if the bag is to function as a pouring bag.

Figure 26:
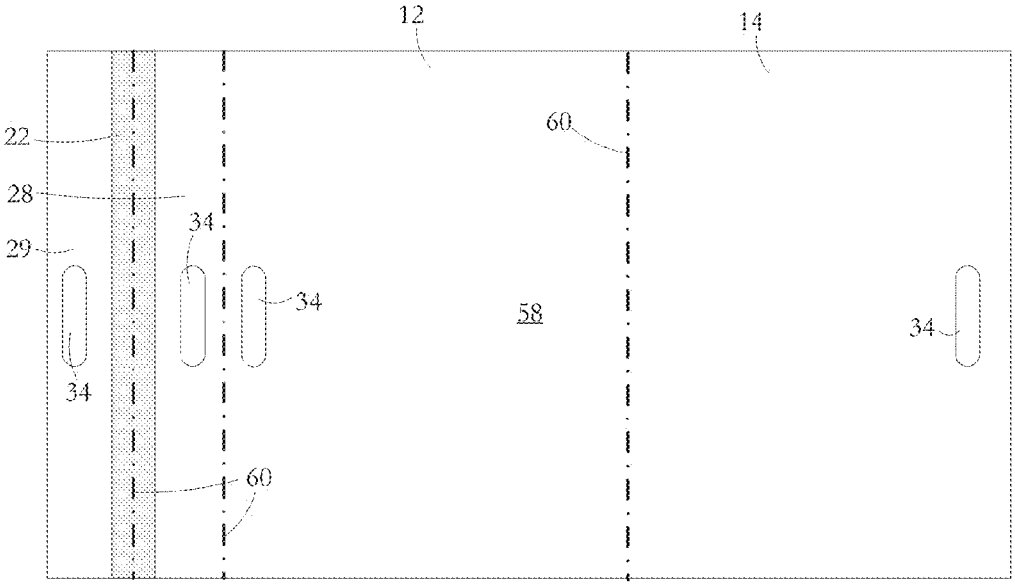
FIG. 26 shows part a sheet plastic web used in the manufacture of a bag according to another embodiment of the invention made using an exemplary manufacturing method.
Figure 27A:
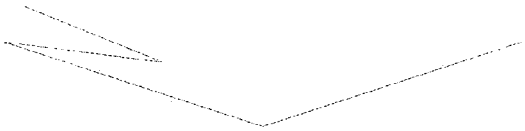
FIGS. 27*a* to 27*d*, are sectional views showing stages in the exemplary manufacturing method described with reference to FIG. 26.
Figure 27B:
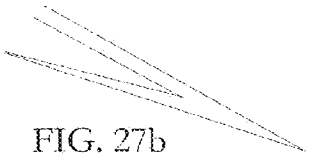
Figure 27C:
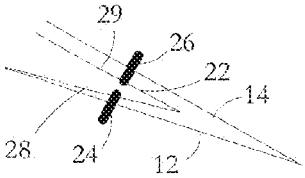
Figure 27D:
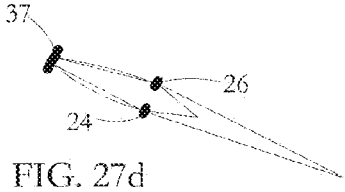

The structure represented in FIGS. 19-25 is formed from two separate web portions 36, 38. Referring to FIGS. 26 and 27, an alternative embodiment of bag 10 is formed from a single web as shown in the exemplary manufacturing sequence depicted by the plan view of FIG. 26 and the schematic sectional views of FIGS. 27*a* to 27*d*. As shown, a web portion 58 has adjoining areas corresponding to the front and back panels 12, 14, the gusset panel 22 and the extension pieces 28, 29. The rectangular web portion 58 of sheet plastic material is subjected to a punching procedure to form carrying apertures 34 and is cut from the web. The web portion 58 is folded at lines 60 to the form shown in FIG. 27*b*. Subsequently, as shown in FIG. 27*c*, a first weld 24 is implemented to join the front panel 12 and the extension piece 28 and a second weld 26 is implemented to join the back panel 14 and the extension piece 29. The gusset panel 22 is defined between the two welds 24, 26. Lastly, as shown in FIG. 27*d*, the upper edges of the extension pieces are seam welded at 37. The welds 24, 26, 37 are spaced from the respective carrying apertures 34, and in the finished structure, the carrying apertures 34 are aligned with each other.

It will be appreciated that because the web portion 58, when fully welded, is in effect an endless loop, the particular positions of the folds 60 and the welds 24, 26, 37 and the sequence of folding and welding can be altered, but with the result that a structure is obtained that is visually and functionally comparable to the structure shown in FIGS. 26 and 27.

Bags made by the processes illustrated in FIGS. 19 to 27, have apertured extension pieces 28, 29 above the welds 24, 26 which function as a handle 62 while the span extending directly between the welds 24, 26 functions as a gusset panel 22. The handle 62 has four thicknesses of sheet plastic material with the weld 37 being a 4-ply weld.

Figure 28:
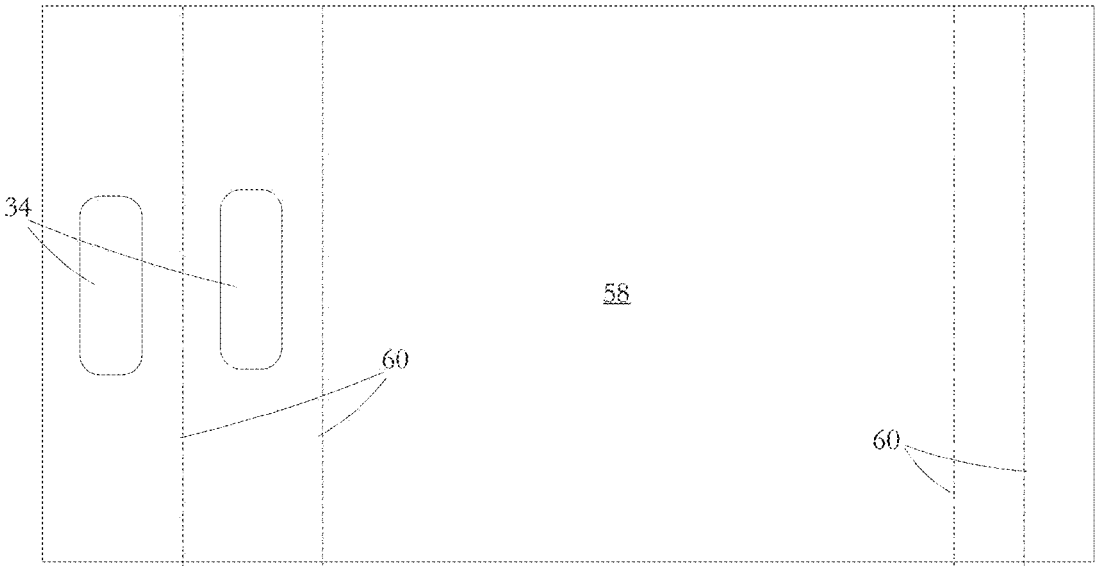
FIG. 28 shows a sheet plastic web used in the manufacture of a bag according to another embodiment of the invention made using an exemplary manufacturing method.
Figure 29A:
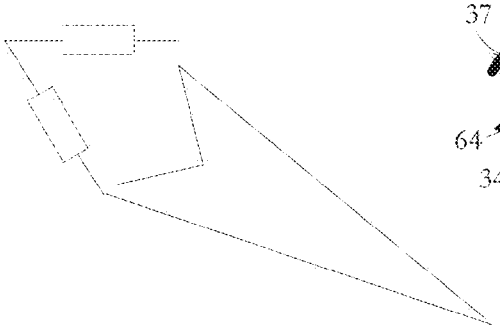
FIGS. 29*a* and 29*b* are sectional views showing stages in the exemplary manufacturing method described with reference to FIG. 28.
Figure 29B:
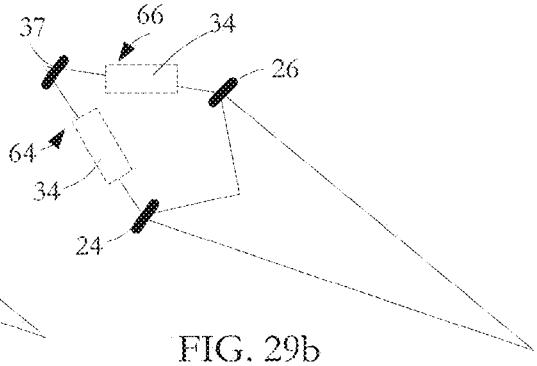

An alternative embodiment is illustrated in FIGS. 28-29, where FIG. 28 shows in plan view an exemplary web portion 58 with carrying apertures 34 and fold positions 60, and FIGS. 29*a*, 29*b* show successive stages in the manipulation and welding of the web portion 58. In this embodiment, there are two handle parts 64, 66, each of a single ply. While this embodiment appears visually similar to the previously illustrated embodiments, the top weld 37 is only a two ply weld and only one thickness of sheet material defines each carrying aperture 34.

Figure 13:
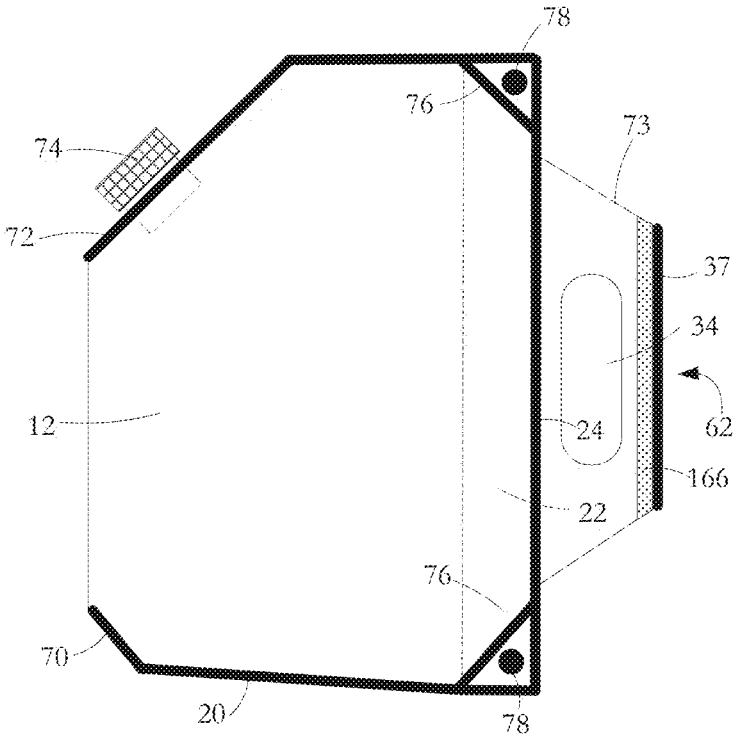
FIG. 13 shows a side view of a bag according to an embodiment of the invention, the bag being particularly equipped for pouring.

As previously indicated, a bag using the design principles of the invention may find application as a jug for containing and storing granular materials and fluids. One such arrangement is shown in FIG. 13. At the junction of the side opposite handle 62 and at the top edge of the bag, the corner is cut as shown along line 72 and a pouring spout/cap combination 74 is partially inserted between the cut front and back panels 12, 14. The cut edges at 72 are then seam welded to each other and sealed around the outer surface of the pouring spout 74. Whereas one form of pouring device is shown, it will be appreciated that the reclosable spout function can be provided by other means such as a slide fastener or zip, a Velcro® fastener, or, if closing is not important, by a simple opening which is cut at the time the container is first used. To improve the "posture" of the bag when functioning as an upright jug, a toe weld is applied as shown at 70. Also, for the same purpose, the weld 20 along the bottom of the bag is inclined upwardly (as shown in FIG. 13) from its junction position with the lower diagonal weld 76 to the toe weld 70. Although not shown in FIG. 13, the web from which the bag 10 is formed can be folded to introduce gussets at any or all of the top, bottom or other side of the bag. The additional gussets can alternatively be implemented as separate inserts with welds being applied to fix the inserts in position.

Depending on the particular carrying and pouring characteristics that are desired and the expected weight distribution of contents in the filled bag, it may be convenient to site the carrying aperture 34 other than generally centrally. For example, the carrying aperture may be situated closer to the top or bottom of the bag. In another alternative, the slot-form aperture may be oriented so as to be inclined to the vertical. In a further alternative, the carrying aperture 34 may be configured as a plurality of apertures for insertion of individual fingers to enhance pouring control.

It will be appreciated that the handle may be held atop the bag for carrying but is normally held at the side for pouring. To assist in the carrying mode if the bag contents will be heavy, any or all of its seams can be strengthened as part of the manufacturing process. A strengthening rod, tube or leaf of thermoplastic material is located at the region of a weld prior to welding so that when the weld is completed it provides greater stiffness than is obtained from a weld made solely of the thermoplastic sheet materials. This is particularly valuable for a bag as illustrated in FIG. 13 which is to function as a pouring jug. It will be understood that some dexterity may be necessary in handling a jug having the bag form described herein, especially if most of the original contents of the bag have been dispensed. As shown in FIG. 13, a locally strengthened zone is formed during manufacture by positioning a thermoplastic rod 166 at the site of the seam weld 37. When this seam is formed, the rod 166 is melted and melds with the material of the extension pieces 28, 29. When the bag is used to pour, the strengthened zone assists in maintaining the jug form of the bag as the contents become depleted. Such a rod or other form of strengthening element can alternatively be welded to the bag in a separate process step after the weld has been applied. In a further alternative, a strengthening element can be mechanically applied, such as by stapling.

If desired for aesthetic or other purposes, a handle 62 which is shorter than the full height of the bag is used by appropriately trimming the web portions as shown at 73 before folding and welding takes place or by punching out the unwanted parts of the bag handle once the welding is complete.

The embodiments of the invention previously described relate to pouch bags which are generally rectangular in plan. In such a pouch bag, for efficient use of plastic sheet material and ease of manufacturability, each of the several panels of the bag is generally rectangular, with seam welds along the boundaries of the panel where it joins other panels which may be gusset panels. It will be appreciated that any of the bag panels, including the extension pieces 28, 29 as illustrated in FIG. 1, can have a shape that is other that rectangular, provided that adjacent panels have appropriate shapes as needed to make the boundary welds possible. For example, the front and back panels 12, 14, which are the major panels in terms of determining the overall shape of the bag 10, may have a generally elliptic or triangular configuration.

Figure 31:
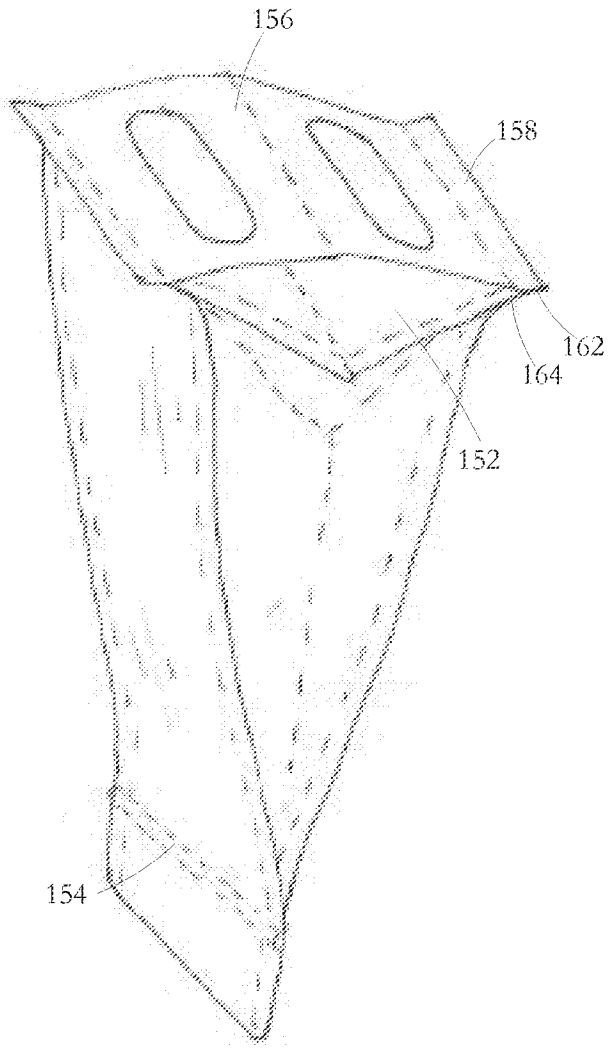
FIGS. 30 and 31 are perspective views from above and below, respectively, of an alternative form of bag according to an embodiment of the invention.
Figure 30:
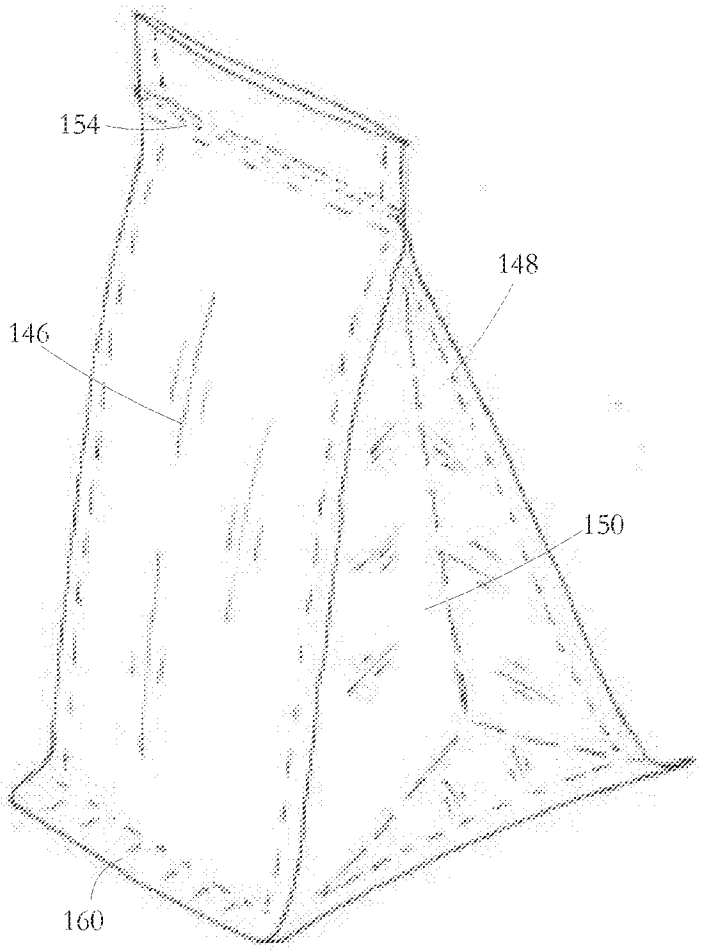

A particular configuration of bag embodying the invention is shown in FIGS. 30 and 31. The bag has front and back panels 146, 148, side gusset panels 150 and a bottom gusset panel 152. The front and back panels 146, 148 have a press-to-close sealing arrangement 154 at the top of the bag. A handle 156 is sealed to the bottom of the bag as shown in the inverted view of FIG. 31. In this arrangement, the handle 156 is heat welded at edges 158 to exposed edge parts 160 of the front and back panels as shown at contact regions 162. Adjacent edge regions of the front and back panels 146, 148 are heat welded to the bottom gusset panel 152 at contact regions 164.

In each of the embodiments of the invention described, the bag is formed from sheet plastic material that is at least partly a heat-sealable thermoplastic material and sealing/welding is effected by heat sealing. Such materials include, by way of example and not limitation, polyolefins such as polyethylene and polypropylene, vinyl polymers, and the like. The materials may be low-, medium- or high-density polymers and may be single or multilayer composite material. Composite laminated materials may include adhesive layers. Sealing resins such as ethylene vinyl acetate may be used to improve sealing of certain polymer layers and the use of such sealing resins may obviate the use of adhesive tie layers. The invention contemplates the use of thermoplastics films which are made of, or which include, a barrier sheet material such as, for example, EVOH or a metal layer which provides a barrier generally preventing the transmission of gases. The thickness of the film material is selected mainly on the basis of the intended weight the bag must carry and generally ranges from about 2 to 20 mils.

The type of thermoplastic sheet material used will depend on the purposes to which the bag is to be put, whether it is easy to handle in manufacturing, whether it can be readily printed upon, whether it is waterproof, whether it is strong enough to resist tearing or bulging, etc.

A particular implementation uses a multi-ply plastic sheet material including a polyethylene layer which makes effective thermoplastic welds/bonds and has high strength, and a layer of polyester which accepts printed indicia very well. In the manipulation of the web portions, generally polyethylene surfaces are brought together where two parts of the sheet material have to be joined so that a bond/weld can be implemented by using thermoplastic heat sealing techniques rather than adhesive bonding. Similarly such manipulation is configured so as generally to present the polyester surfaces outwardly for application of print indicia. It will be understood however, that whereas thermoplastic welding of materials such as polyethylene is preferred, a bag according to this invention can be manufactured with any or all of the welded seams being substituted by adhesive seams.

In one example, the sheet plastic material of the bag has a polyethylene layer 1 to 7 mils thick, an adhesive polymer layer 0.1 to 0.5 mils thick, and a polyester layer 0.5 mils thick, the layers being coextruded or adhesively laminated. The layer thicknesses can be varied depending on desired sheet material characteristics. For example, the polyester layer which is better suited for accepting printed indicia than the polyethylene, can be made somewhat thicker to provided increased stiffness to the bag. This can be quite important where the bag is to function as a pouring bag and will be lodged or stored in an upright position similar to a jug. The multilayer plastic material can include additional layers of material depending on characteristics desired in the finished material. In another example, the plastic sheet material has outer layers of polyethylene so that both surfaces of the material are heat sealable. In yet another example, the plastic sheet material has a layer of nylon for added strength and/or a barrier layer such as metal foil, metallized polyester or EVOH. The selection of ply materials and the number of layers of each material is chosen for the particular properties desired in the bag. Thus, polyethylene has good heat sealing properties and relatively high strength. A copolymer polyethylene with high elastomeric content can be used where a softer material is required. The sheet film material or particular web portions used in the bag construction can be formed from thermoplastic film that has been oriented during manufacture to impart mechanical strength along a particular axis or at a critical stress site. Such oriented strength can be imparted by for example stretching at ambient temperatures, melt orienting during extrusion, etc. Heat sealing and bonding of layers of sheet material is effected by the application of temperature and pressure for a predetermined time at locations where the layers are to be heat sealed. The temperature, pressure and time are selected based on the particular nature of the sheet materials being bonded together. Bonding is typically effected at multiple bonding stations, with the bonded material subsequently being cooled.

Referring back to FIG. 1, whereas the various weld lines, whether they are to weld sheet material edges together as at the welds 18, 20 or to weld the faces of two panels together as shown at welds 24, 26, are shown in the illustrated embodiments simply as straight lines, other more complex welds can be used to obtain particular bag characteristics. For example, as shown in FIG. 13, at the end of the gusset panel 22, diagonal area welds 78 are used at each pair of the overlapping sheet materials to effect a neat end formation for the gusset panel 22. It will be appreciated that a weld may contribute to any or all of structural shape, strength sealing and "posture" benefits. For effective sealing, both to prevent loss of contents and also to prevent intrusion from outside of contaminants, welds must overlap at their junctions.

There have been described herein various embodiments of a bag structure. Also described in brief detail are particular production process steps involved in manufacturing such bag structures. Such embodiments and processes have features that distinguish the present invention from the prior art. It will be apparent to those skilled in the art that the bags and the manufacture thereof may be modified in numerous ways and may assume many embodiments other than the preferred forms specifically set out and described above. Accordingly, it is intended by the appended claims to cover all modifications of the invention which fall within the scope of the invention.

What is claimed is:

1. A bag having a front panel, a back panel, and a gusset panel, all formed of multi-ply plastic sheet material, each panel having a thermoplastic ply at its interior face and a non-thermoplastic ply at its exterior face;

the gusset panel having a first interior margin portion along one side thermally welded to a second interior margin portion of the front panel at a first join, and a third interior margin portion along an opposed side thermally welded to a fourth interior margin portion of the back panel at a second join;

a first extension integral with the front panel and extending from the first join, and a second extension integral with the back panel and extending from the second join, the first extension having a first seam portion spaced from the first join, the second extension having a second seam portion spaced from the second join, the first and second seam portions having thermoplastic ply portions facing one another and thermally welded together at a third join;

the first and second extensions each having a carrying aperture formed therein;

the gusset panel having a third extension integral with the gusset panel and extending from the first join, and having a fourth extension integral with the gusset panel and extending from the second join, the third extension thermally welded to the first extension, the fourth extension thermally welded to the second extension, the third and fourth extensions each having a carrying aperture formed therein, the carrying apertures in the extensions aligned with one another; the first and second extensions overlapping the third and fourth extensions respectively at first and second overlaps, a part of one of the first and second extensions projecting beyond the respective overlap being a respective one of the first and second seam portions.

2. A bag as claimed in claim 1, wherein cumulatively, the spacing of the first join from the third join plus the spacing of the second join from the third join is greater than the spacing of the first join from the second join across the gusset panel.

3. A bag as claimed in claim 1, the front and back panels and the first and second extensions formed from a first, folded web of multi-ply plastic sheet material, the gusset panel and third and fourth extensions formed from a second, folded web of multi-ply plastic sheet material.

4. A bag as claimed in claim 1, said second interior margin portion of the front panel forming a part of the perimeter of the front panel, said third interior margin portion of the back panel forming a part of the perimeter of the back panel, the remaining part of the front panel perimeter sealed to the remaining part of the back panel perimeter.

5. A bag as claimed in claim 4, the seal between the remaining part of the front panel and the remaining part of the back panel including a bridging element.

6. A bag as claimed in claim 5, the bridging element being a spout, the spout and a handle defined by the carrying apertures being on generally opposed sides of the bag.

7. A bag as claimed in claim 5, the bridging element being a second gusset panel.

8. A bag as claimed in claim 5, the seal between said remaining part of the front panel and said remaining part of the back panel including a weld over at least part thereof between overlapping margin portions of the front panel and the back panel.

9. A bag as claimed in claim 1, at least one ply of the multi-ply material being a barrier layer generally preventing the transmission of gases.

10. A bag as claimed in claim 1, the joins extending generally along the length of the bag, the extensions being of a length less than the first and second joins.

11. A bag as claimed in claim 1, the carrying apertures being of slot form.

12. A bag as claimed in claim 1, further comprising a strengthening member at the third join.

13. A bag as claimed in claim 1, the gusset panel and the extensions together forming a generally hollow tube, the tube generally flattened when the bag is empty and expanding to a generally triangular cross section for accommodating a hand part for carrying of the bag when the bag is filled.

14. A bag as claimed in claim 1, the bag initially open at a position remote from the gusset panel to permit filling and sealing.

15. A bag having a front panel, a back panel, and a gusset panel, all formed of multi-ply plastic sheet material, each panel having a thermoplastic ply at its interior face and a non-thermoplastic ply at its exterior face;

the gusset panel having a first interior margin portion along one side thermally welded to a second interior margin portion of the front panel at a first join, and a third interior margin portion along an opposed side thermally welded to a fourth interior margin portion of the back panel at a second join;

a first extension integral with the front panel and extending from the first join, and a second extension integral with the back panel and extending from the second join, the first extension having a first seam portion spaced from the first join, the second extension having a second seam portion spaced from the second join, the first and second seam portions having thermoplastic ply portions facing one another and thermally welded together at a third join;

the first and second extensions each having a carrying aperture formed therein;

the gusset panel having a third extension integral with the gusset panel and extending from the first join, and having a fourth extension integral with the gusset panel and extending from the second join, the third extension thermally welded to the first extension, the fourth extension thermally welded to the second extension, the third and fourth extensions each having a carrying aperture formed therein, the carrying apertures in the extensions aligned with one another; the first and second extensions overlapping the third and fourth extensions respectively at first and second overlaps, a part of one of the first and second extensions exposed through an aperture in the respective overlapping third or fourth extension being a respective one of the first and second seam portions.

16. A bag as claimed in claim 15, wherein cumulatively, the spacing of the first join from the third join plus the spacing of the second join from the third join is greater than the spacing of the first join from the second join across the gusset panel.

17. A bag as claimed in claim 15, the front and back panels and the first and second extensions formed from a first, folded web of multi-ply plastic sheet material, the gusset panel and third and fourth extensions formed from a second, folded web of multi-ply plastic sheet material.

18. A bag as claimed in claim 15, said second interior margin portion of the front panel forming a part of the perimeter of the front panel, said third interior margin portion of the back panel forming a part of the perimeter of the back panel, the remaining part of the front panel perimeter sealed to the remaining part of the back panel perimeter.

19. A bag as claimed in claim 18, the seal between the remaining part of the front panel and the remaining part of the back panel including a bridging element.

20. A bag as claimed in claim 19, the bridging element being a spout, the spout and a handle defined by the carrying apertures being on generally opposed sides of the bag.

21. A bag as claimed in claim 19, the bridging element being a second gusset panel.

22. A bag as claimed in claim 18, the seal between said remaining part of the front panel and said remaining part of the back panel including a weld over at least part thereof between overlapping margin portions of the front panel and the back panel.

23. A bag as claimed in claim 15, at least one ply of the multi-ply material being a barrier layer generally preventing the transmission of gases.

24. A bag as claimed in claim 15, the joins extending generally along the length of the bag, the extensions being of a length less than the first and second joins.

25. A bag as claimed in claim 15, the carrying apertures being of slot form.

26. A bag as claimed in claim 15, further comprising a strengthening member at the third join.

27. A bag as claimed in claim 15, the gusset panel and the extensions together forming a generally hollow tube, the tube generally flattened when the bag is empty and expanding to a generally triangular cross section for accommodating a hand part for carrying of the bag when the bag is filled.

28. A bag as claimed in claim 15, the bag initially open at a position remote from the gusset panel to permit filling and sealing.

* * * * *